US005618252A

United States Patent [19]

Melville

[11] Patent Number: 5,618,252

[45] Date of Patent: Apr. 8, 1997

[54] PACKAGING APPARATUS

[75] Inventor: Richard A. Melville, Auckland, New Zealand

[73] Assignee: Machinery Developments Limited, Auckland, New Zealand

[21] Appl. No.: 198,092

[22] Filed: Feb. 17, 1994

Related U.S. Application Data

[63] Continuation-in-part of Ser. No. 920,418, Jul. 27, 1992, abandoned.

[30] Foreign Application Priority Data

Jul. 26, 1991 [NZ] New Zealand ..... 239153
Mar. 26, 1993 [NZ] New Zealand ..... 247267

[51] Int. Cl.[6] ..... B31B 1/00

[52] U.S. Cl. ..... 493/22; 493/10; 493/24; 493/194; 493/201; 493/212; 493/341; 493/27

[58] Field of Search ..... 493/8, 10, 22, 493/24, 186, 189, 194, 196, 199, 200, 201, 203, 212, 227, 309, 313, 314, 319, 341, 27, 28, 34, 35, 36; 53/381.5, 570

[56] References Cited

U.S. PATENT DOCUMENTS 2,195,740 4/1940 Salfisberg .
3,161,002 12/1964 Duns .
3,448,555 6/1969 Shabram .
3,492,783 2/1970 Dohmeier .
3,557,526 1/1971 Hartman .
3,774,367 11/1973 Lerner .
3,908,343 9/1975 Farrelly .
4,061,326 12/1977 Proudman ..... 493/36
4,202,153 5/1980 Lerner et al. .
4,346,546 8/1982 Tasker .
4,494,364 1/1985 Meyn .
4,553,376 11/1985 Okada et al. .
4,586,318 5/1986 Litt et al. .
4,694,638 9/1987 Maddux, Jr. et al. .
4,779,400 10/1988 Hoskinson et al. .
4,938,007 7/1990 Sperry .
4,945,714 8/1990 Bodolay et al. .
5,024,042 6/1991 Meyer .
5,041,070 8/1991 Blaser ..... 493/14
5,094,061 3/1992 Evers .
5,139,151 8/1992 Chelak ..... 206/523

FOREIGN PATENT DOCUMENTS 2139470 4/1972 Germany .
1137057 12/1968 United Kingdom .

*Primary Examiner*—Willis Little
*Assistant Examiner*—Eileen P. Morgan
*Attorney, Agent, or Firm*—Young & Thompson

[57] ABSTRACT

Apparatus is disclosed for producing discrete packages which can be individually varied in length so that they can be used for packaging articles such as cuts of meat which vary in length. The apparatus comprises drive rolls for feeding a flat tube of plastics packaging material through a cut off device. The apparatus may also comprise a heat sealing device (to form the tube into a bag) and a blower head combined with a suction device which opens the leading portion of the bag to facilitate the placing of an article in the bag. A proximity sensor is provided adjacent the cut off device and immobilizes the drive rolls when it detects the arrival of a loading portion. In one form of the apparatus the sensor is mounted on a movable carriage which can be quickly moved by hand or by a ram. In another form of the apparatus electronic controls are provided which can vary the number of revolutions of the drive rolls, the rotational speed thereof or the period of rotation thereof to preset the length of each leading portion. These controls can be adjusted by hand or by a device which measures the length of an article which is about to be packaged.

8 Claims, 7 Drawing Sheets

PACKAGING APPARATUS

This application is a continuation-in-part of application Ser. No. 07/920,418 filed on 27 Jul. 1992, now abandoned.

FIELD OF THE INVENTION

This invention relates to an apparatus for producing packages. It has particular but not necessarily exclusive application to the production of bag-like packages from a flat tube of plastics film fed off a roll of such film.

BACKGROUND OF THE INVENTION

Machines for producing such packages are well known. However, before development of the applicant's present invention, all commercially available machines of this type known to the applicant were designed to produce packages of a predetermined length and, in a practical sense, were incapable of being readily adjusted to produce short runs of packages or even single packages of varying length.

Various means are employed in such commercially available machines to change the bag length. In a commonly known type of machine, exemplified in the specification of British patent #1137057, the drive rollers for advancing the tube stock are operated stop/start fashion by a crank mechanism. The throw of the crank can be varied to alter the length of bag produced by the drive rollers. This arrangement is quite unsuitable for quick changes of bag length.

In a commercially available type of plastic bag making machine the drive rollers are also operated stop/start fashion. They are digitally controlled to feed the tube stock a distance determined by punching a desired bag length into a numeric keypad on the machine. Such machines are designed to produce about 100/200 bags per minute so, in day to day operation, changing bag length between each bag or even after a run of few bags would be out of the question.

Bag making machines which are installed at a workstation where goods are packaged at the same time as the bags are made or dispensed can be divided into three different classes:

a. machines which are intended for the high speed packaging of long runs of articles which are mutually identical or of liquids in mutually identical quantifies. Examples of such machines are shown in U.S. Pat. Nos. 3,537,225 (Fields), 4,346,546 (Tasker) and 3,557,526 (Hartmann).

b. the applicant is aware of a single patent, U.S. Pat. No. 3,161,002 (Duns), showing a machine from which bags of varying length can be obtained.

c. machines for dispensing pre-made bags. A machine of this type is disclosed in U.S. Pat. No. 3,908,343. Such machines are not relevant to the present invention.

In the above mentioned patents, the only machine which is intended to produce bags whose length can be varied as each bag is made is shown in the Duns patent. In this machine the bag length is varied by the operator who manually draws off the require length of tube from the tube stock each time a bag is made. It will be clear to those skilled in the an that the remaining patents show machines which are quite unsuitable for quick changes of bag length. That they are all intended for producing long runs of bags of constant length is apparent from the descriptions of the length changing mechanism in each case in combination with the other parts of the machine and the product to be packaged.

In certain circumstances, producers of goods of variable length which require similar packaging would find such machines of substantial commercial benefit. Thus the present invention has particular but not exclusive application to the factory packaging of joints of meat and other articles of somewhat variable size.

SUMMARY OF THE INVENTION

According to the invention there is provided apparatus of the kind which produces discrete packages of variable length from a stock of flexible laminar packaging material by feeding successive leading portions of a flat elongate tube formed from the stock and separating said leading portions from the stock, the apparatus including tube feed means and tube cut-off means which are respectively operable to feed and separate said leading portions from the stock, and control means for controlling the operation of the apparatus, which control means comprises a length determining means which, in a normal operational mode of the apparatus, is operator actuated to cause the apparatus to vary the length of each said leading portion, a switch means which is operably interconnected with the tube feed means and which, in said normal operational mode of the apparatus, is operator actuated to cause the tube feed means to feed each said leading portion from the stock, and detecting means operably interconnected with the tube feed means and arranged, upon detecting the presence of a said leading portion fed from the stock, to immobilise the tube feed means.

The term "operator actuated" as used in this specification and in the claims envisages that the apparatus can be operated in a normal mode of operation to produce packages each of which can have a unique length. Further, that for this purpose the apparatus is provided with length determining means which and switch means must both be actuated by an operator each time a bag is to be produced. And, still further, that the operator may either be a human operator or a device (or combination of devices) which is set up to measure the lengths of articles to be inserted in the packages and which is operably interconnected with the length determining means and the switch means to cause the apparatus to produce a package only when an article is detected and measured, the length of the package being determined by the length of that article.

In one aspect of the invention the length determining means includes a carriage and means for positioning the carriage at a variable distance from the tube feed means, the detecting means being mountable on The carriage and providing a signal upon detecting the arrival of a said leading portion at the carriage, and disenabling means is provided which in response to a said signal interrupts the operation of the tube feed means.

In another aspect of the invention the tube feed means comprises at least one drive roller over which the tube passes to draw the tube from the stock and a motor for driving the drive roller, the length determining means comprising a control means which is arranged to control the operation of the motor and which is set by a human operator to cause the motor and drive roller to vary the length of each said leading portion.

In one form of the invention the length determining means comprises a counting device operably connected to the motor and the control means is arranged to start the motor upon actuation of the switch means and to stop the motor after the counting device has counted a number of revolutions (or fractions of revolutions) performed by the motor or the drive roller, which number can be set by the control means.

In an alternative form of the invention the length determining means comprises a timing device operably connected to the motor and the control means is arranged to start the motor and to stop it after a period of time counted by the timing device, which period can be set by the control means.

In a second alternative form of the invention the length determining means comprises a motor speed control device operably connected to the motor and the control means is arranged to run the motor at a speed which can be set by the control means.

According to one aspect of the invention the switch means is actuated by a human operator to cause the tube food means to feed each said leading portion from the stock.

According to another aspect of the invention, the detecting means comprises a proximity sensor which is operably interconnected with switch means which can be actuated by a signal provided by the sensor upon detecting the removal of a said loading portion from the proximity of the sensor to mobilise the tube feed means.

Advantageously, according to the invention, the length determining means includes operator actuated proselector means which is operably interconnected with the tube feed means to cause the tube feed means to feed a leading portion of preset length from the stock.

The apparatus may comprise a suction device arranged to apply suction to a first layer of a said leading portion of the tube, and means to separate a second layer thereof from the first layer. The apparatus may also comprise sealing means located adjacent the cut-off-means for scaling a rear edge of the leading portion of the tube.

In any of the above mentioned alternatives the length determining means may include a keying device by means of which a human operator can key in a number or similar information which determines the length of a said leading portion. The keying device is operably integrated with the drive roller to cause it to be stopped after a length of tube has been fed through the belts corresponding to the keyed-in number or information. The keying device may advantageously incorporate one or more keys or buttons which, if actuated, cause the apparatus to produce a package of preset length.

The invention may be applied to package producing apparatus which scores or perforates the tube or otherwise creates a line of weakness across the tube instead of severing it so that the leading portions will preferentially separate from the tube along the lines of weakness. The term "separate" should be interpreted with due regard to the above whenever it is used in this specification and in the claims.

BRIEF DESCRIPTION OF THE DRAWINGS

The invention is further discussed with reference to the accompanying drawings in which.

DETAILED DESCRIPTION OF THE EMBODIMENTS SHOWN IN THE DRAWINGS

Figure 1:
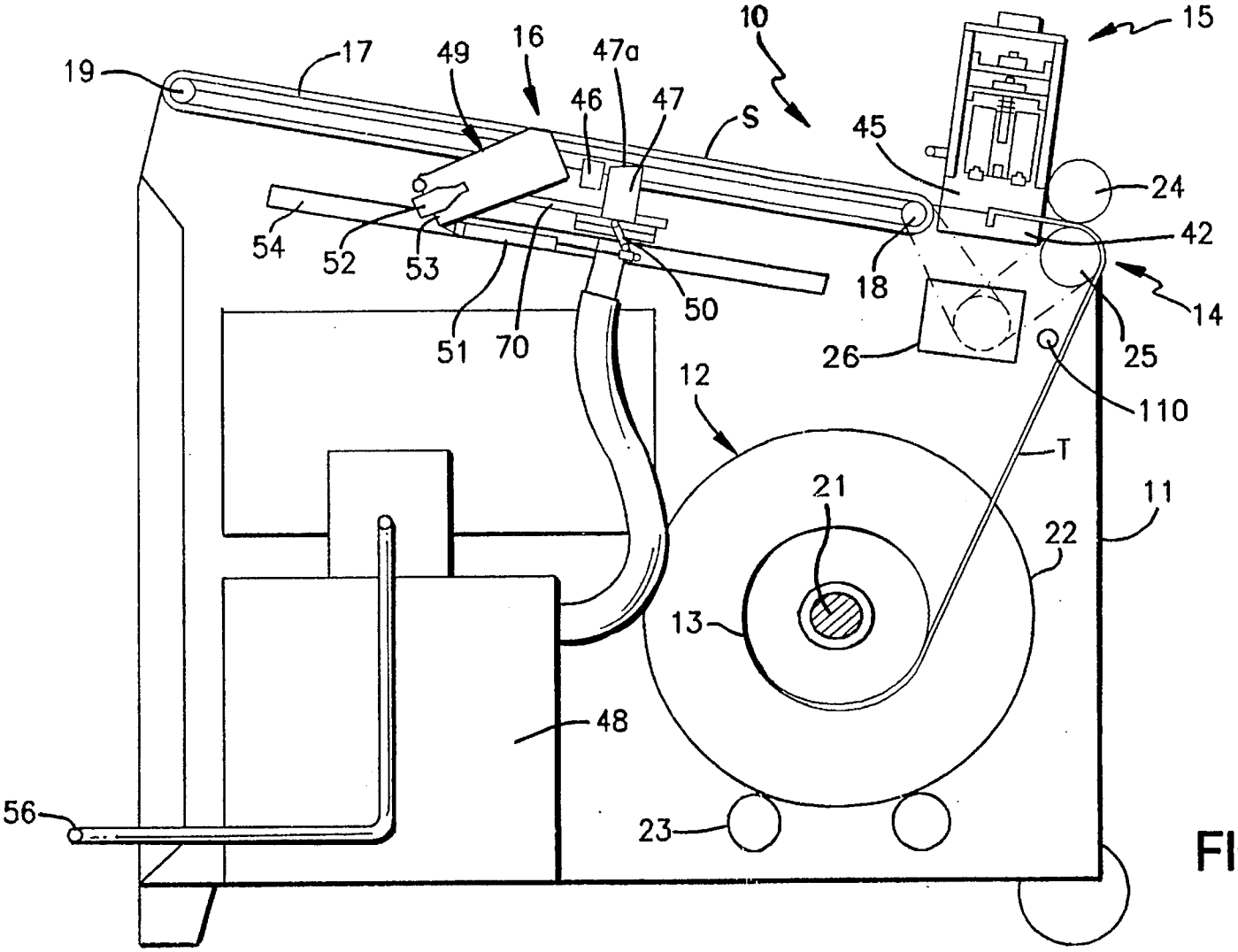
FIG. 1 is a somewhat schematic sectional side view of a packaging apparatus.
Figure 2:
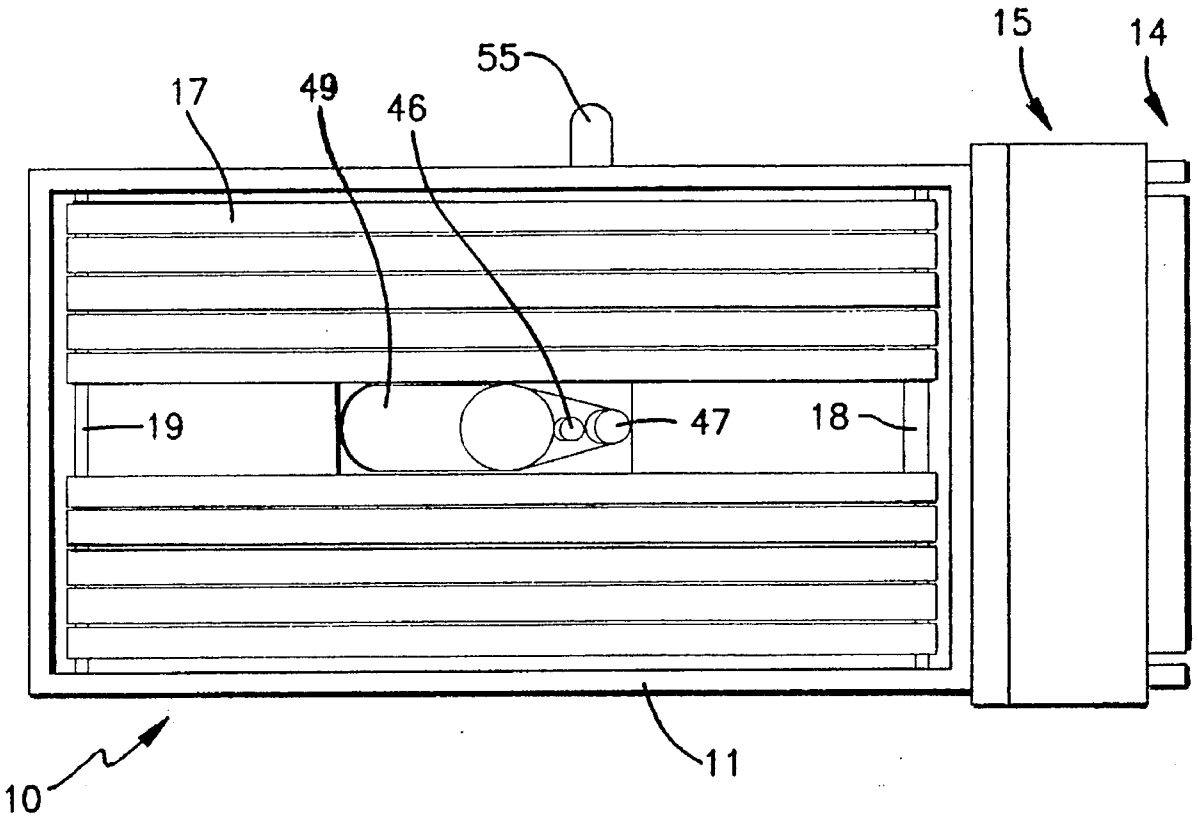
FIG. 2 is a plan view of the apparatus shown in FIG. 1.

Referring to FIGS. 1 to 5 the apparatus 10 comprises number of interactive mechanisms mounted on a frame 11. These mechanisms include a spindle assembly 12 which carries a roll 13 of heat sealable plastics film in the form of a flat tube T. The tube T is fed from the roll to a drive roller assembly 14 located at what will be called the feed end of the frame. For clarity only two rolls 24, 25 of this assembly are shown in FIG. 1. The drive roller assembly 14 feeds the tube T past a heat sealing and cut-off mechanism 15 and over an assembly of endless belts 17 mounted between drums 18, 19. The drum 18 is located adjacent the mechanism 15 and the drum 19 is located adjacent the opposite end of the frame. A tube opening mechanism 16 is located between the drums 18, 19.

The spindle assembly 12 comprises a spindle 21 provided with bearings on which are mounted a cardboard tube located at the centre of the roll 13. The roll thus rotates about the spindle. The spindle also carries disc shaped plates 22 mounted at each end of the roll. The plates rest on cross members 23 mounted on the frame 11. The tube T can thus feed freely off the roll and the spindle assembly can be lifted off the cross members for easy replacement of the roll 13.

Figure 3:
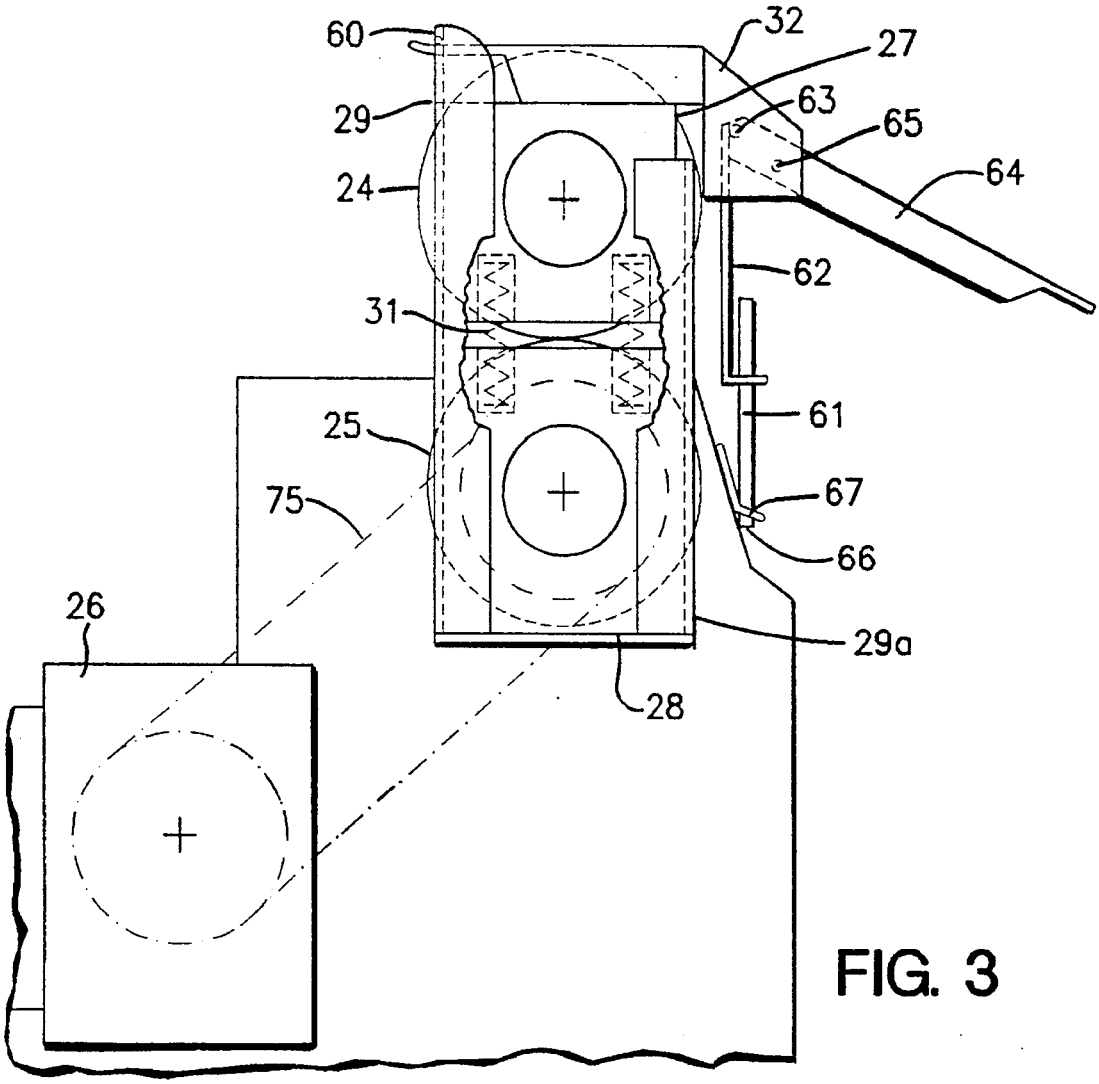
FIG. 3 is a detailed sectional view of the manner of mounting a pair of drive rolls.

Referring particularly to FIG. 3, the drive roller assembly 14 comprises upper and lower drive rolls 24, 25 mounted, in the present example, in bearing blocks 27, 28 of self lubricating plastics material such as Teflon™. The lower roll is driven through a sprocket chain 75 by an electric motor/gear box assembly indicated at 26. The upper roll is geared to the lower roll. The bearing blocks are mounted in vertical slide rails 29, **29*a* fixed to plates mounted on the frame. Compression springs 31 are mounted in recesses in the bearing blocks and tend to force the bearing blocks apart. The blocks are retained in place by toggles 32. The inner end of each toggle is provided with a pin 60 which is hooked into a recess adjacent the upper end of each inner slide rail 29. The outer end of each toggle is drawn downwardly by an over-centre catch arrangement. This comprises a screw threaded catch 61 which engages the lower end of a leg 62 pivoted at 63 to a handle 64. The handle is in turn pivoted at 65 to the toggle. The length of the leg and catch assembly can be adjusted by turning the catch 61 in the leg 62. The catch has a T shaped head 66 which, when the handle is raised, engages a hook 67 mounted on the frame 11. When the handle is lowered the toggle is drawn downwardly against the upper block 27 and the pans are locked in place by the over centre motion of the handle and leg. Pressure is applied to the upper roll 24 by the toggles. The upper roll in turn bears on the lower roll 25 with a pressure which can be altered by adjusting the length of the legs 62. When the toggles are released the upper roll 24 is lifted by the springs 31 thus enabling the leading end of a tube T from a fresh roll 13 to be passed between the rolls 24, 25**. The adjustability of the catch assemblies is important to enable the apparatus to handle film of varying characteristics. Moreover, the pressure applied to each end of the rolls can be independently adjusted. This is important since it enables the direction in which the tube is fed out of the rolls to be accurately adjusted.

The heat sealing and cut-off mechanism 15 comprises a guillotine-like blade 33 mounted on a cross bar 34. Upwardly projecting studs 35 are fixed on the cross bar and slide in a cross plate 36 mounted on the frame 11. Between the cross bar 34 and the cross plate 36, a washer plate 37, an air bag 39, springs 38 and a block 41 are slidably mounted over the studs. The air bag is connected through n connector 39*a* by suitable pipe work (not shown) to a source of compressed air. A conventional, electrically operated shut off valve mounted in the pipe work controls the supply of air to the air bag. Two clamping bars 40 are mounted on the lower face of the block 41 and located one on either side of the cross bar 34. The cross bar 34 is located in a recess 41*a* in the block.

An aluminum plate 42 is mounted on the frame 11 below the cross bar 34. The plate has an upper face 43 which is aligned with the line of contact between the drive rolls 24, 25. A nichrome ribbon 44 sandwiched between two layers of Teflon™ tape is laid on the face 43 directly underneath the inner clamping bar 40. The nichrome wire is connected to a source of electrical power through a switching arrangement which will be discussed in greater detail below. There is a space 45 between the face 43 and the clamping bars through which the tube T passes as it feeds out of the drive roller assembly 14. As will be discussed below in detail, the tube T is stopped at intervals for the purpose of forming a bag in the tube T. This is achieved by inflating the air bag 39 which advances the studs 35 downwardly until the clamping bars 40 come up against the plate 42, clamping the tube T against the face 43. At this stage the nichrome bar is heated and causes the upper and lower layers of the tube T to weld together. The Teflon™ tape around the nichrome ribbon helps to prevent the tube T from adhering to the plate 42. Inflation of the air bag continues. The cross bar 34 and blade 33 are hence driven downwardly in the recess 41*a* against the action of the springs 38 so that the blade 33 severs the tube T. When the air bag is deflated the blade 33 and the clamping bars are retracted into the recess.

The upper bights of the belts 17 collectively constitute a moving surface S at the top of the frame. The drums 18, 19 are positioned so that this surface S lies in substantially the same plane as the upper face 43 of the plate 42. The drum 19 is located at a higher level than the drum 18 so that the surface S slopes upwardly from the tube feeding end of the frame. The drum 18 is driven through a sprocket chain 75*a* by the same motor/gear box assembly 26 that drives the drive roll 24, the speed of the surface S being equal to or greater than the peripheral speed of the roll 24. Consequently the tube T encounters no friction as it advances across the top of the frame; moreover the bolts tend to keep it advancing in a straight line until the leading edge of the tube T arrives at the tube opening assembly 16.

The assembly 16 is located between the two centre belts 17. The assembly 16 comprises a plate 70 on which are mounted a proximity sensor 46; a vacuum head 47 connected through a flexible hose to a vacuum pump 48; and a bag opening head 49 connected to a source of compressed air (not shown). The vacuum head is located between the mechanism 15 and the bag opening head and the nozzle 47*a* of the vacuum head is positioned flush with or just below the moving surface S. When the proximity sensor senses the arrival of the leading edge of the tube T, the drive roller mechanism is stopped and the heat sealing and cut-off mechanism 15 is actuated (as will be further described below). The vacuum head is also actuated. The lower layer of film in the tube T is sucked against the nozzle 47*a*. The nozzle is preferably of substantial area, in the present example, about 12 sq. cm. The lower layer of film, where it is sucked against the nozzle, is drawn away from the upper layer. This materially assists the separation of the two layers and reduces the likelihood of the lower layer becoming detached from the vacuum nozzle.

In the example illustrated the suction of the vacuum head is controlled by means of a butterfly valve in the throat of the head. The butterfly valve is mounted on a shaft one end of which is connected to a lever 50. The butterfly valve is operated by a pneumatic ram 51 connected to the lever 50. The ram 51 is connected through pipe work (not shown) to a source of compressed air through a second conventional electrically actuated shut-off valve.

The bag opening head 49 comprises a nozzle 52 connected to a source of compressed air through pipe work (not shown). Yet another conventional electrically actuated shut-off valve in the pipe work controls the supply or air to the nozzle 52. The nozzle 52 is mounted in the lower end of an upwardly inclined open ended sleeve 53. The assembly functions as a venturi; i.e. when air emerges from the nozzle 52 it draws further air through the lower end of the sleeve. The shut-off valve is closed until, following the arrival of the leading edge of the tube T at the proximity sensor 46, the heat sealing and cut-off mechanism 15 and the vacuum head have been actuated as described above. The air emerging from the upper end of the sleeve 53 is directed at the leading edge and lifts the upper layer of film at the mouth of what is now a bag in the tube T away from the lower layer. The mouth of the bag is thus automatically opened.

A bracket 72 carrying rollers 74 is mounted on the plate 70. The rollers run on a track 54 in the form of a stainless steel pipe located under the belts 17. By this means the assembly 16 can be readily moved to any position on the track corresponding to the length of bag required. The plate 70 is provided with a handle portion 55 which projects through a slot in the frame 11 for this purpose. Also provided is a brake 76 which bears on the track for locking the plate 70 in position. The brake is mounted on an L-shaped lever 78 which is pivoted to the handle 55. A tension spring connected to the lever urges the brake into contact with the track. The brake is released by lifting the portion 78*a* of the lever which is located under the handle 55.

The proximity sensor 46 is of conventional light actuated type and is located between the vacuum head and the bag opening head. It could also be located inside the vacuum head. Through electronic circuitry which includes a timing device and a kick operated master control switch indicated schematically at 56 it is interconnected to the various mechanisms described above. These mechanisms are electronically controlled and their sequence of operation will now be described.

The bag opening head 49 is first moved to a desired position on the track 54. It is assumed that a new roll 13 of film is mounted on the spindle 21. When the apparatus is switched on the vacuum pump 48, drive rolls 24, 25 and belts 17 will not be started until the kick switch 56 is actuated. The roll 24 is raised and the tube T is initially drawn off the roll by hand and fed through the drive rolls 24, 25. The roll 24 is lowered and clamped in position. The operator stands at the end of the apparatus opposite the tube feed end and actuates the kick switch 56. This starts the drive rolls and the belts 17. The tube T is fed by the rolls through the space 45 and along the belts 17. When the proximity sensor senses the arrival of the leading edge of the tube T the drive roller mechanism is stopped and the vacuum pump is switched on. The heat scaling and cut-off mechanism is actuated to form a bag. The butterfly valve controlling the vacuum head 47 is opened and the lower layer of film in the bag is sucked against the nozzle of the vacuum head 47. Momentarily thereafter the shut-off valve for the nozzle 52 of the bag opening head is opened, causing the mouth of the bag to be opened by the ensuing air blast. The joint of meat (or other article to be packaged) is placed in the bag. This is assisted by the downward slope of the belts. The bagged joint of meat is removed and the cycle is started again by actuating the kick switch.

The tube T may sometimes adhere to the clamping bar 40 above the nichrome wire. It must then be detached in order to ensure that the tube advances properly. For this purpose the drive rolls are momentarily reversed after the cut off operation. The tube is thus pulled back a distance of perhaps 1 cm, ensuring that it is detached from the clamping bar 40. It is then advanced again until the leading edge reaches the proximity sensor as already describe.

It may be advantageous to provide a vacuum tank and means to operate the vacuum pump automatically w maintain a constant vacuum in the tank. The vacuum at the head may then be controlled simply by operating the butterfly valve.

Figure 6:
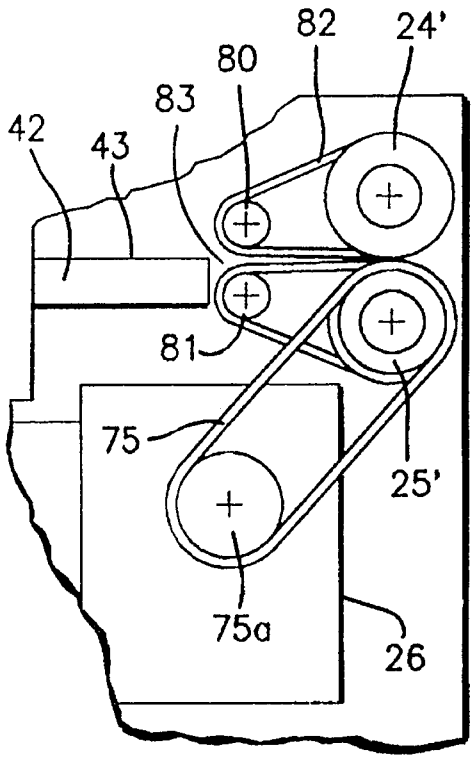
FIG. 6 is a sectional view of an alternative arrangement for the drive rolls.

A modified arrangement for the drive rolls is shown in FIG. 6. In this case the drive rolls 24', 25' are substantially similar those already described as is the mechanism for driving them. However, a pair of drums 80, 81 is mounted on the frame between the drive rolls and the plate 42. Endless belts 82 are mounted between the roll 24' and the drum 80 and also between the roll 25' and the drum 81. The rolls and drums are positioned so that there is a substantially flat gap 83 between the upper and lower sets of belts which gap is substantially coplanar with the upper face 43 of the plate 42. By this means the tube T is accurately guided over the face 43 and onto the moving surface S.

Figure 7:
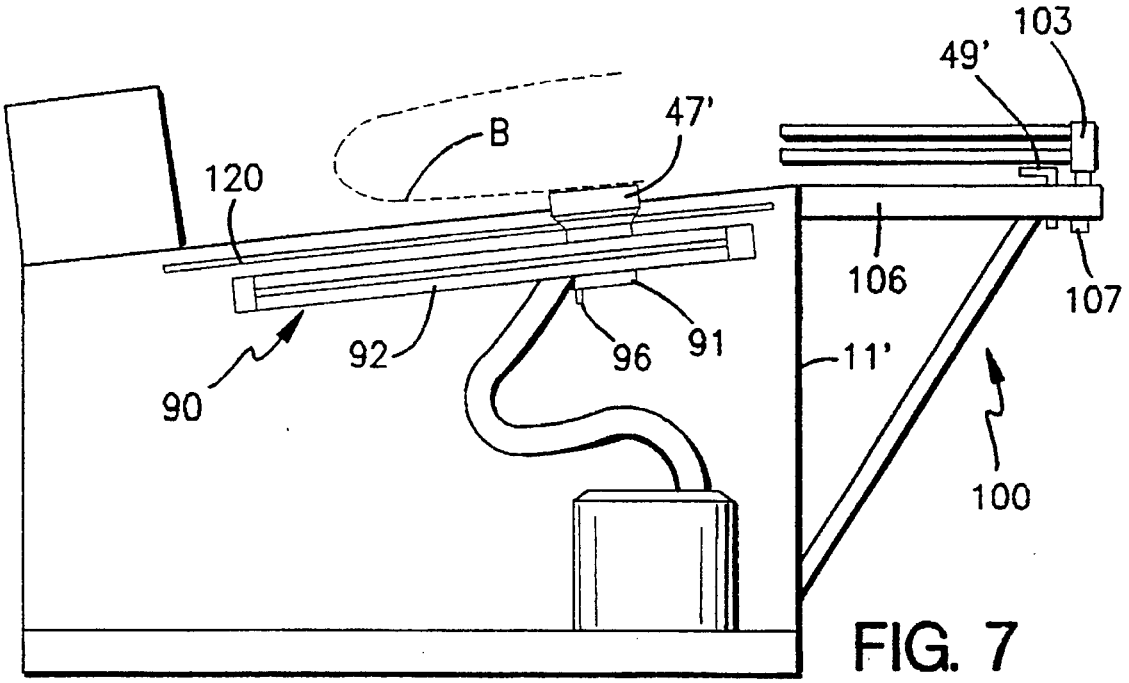
FIG. 7 is a sectional side view of a modified apparatus.
Figure 8:
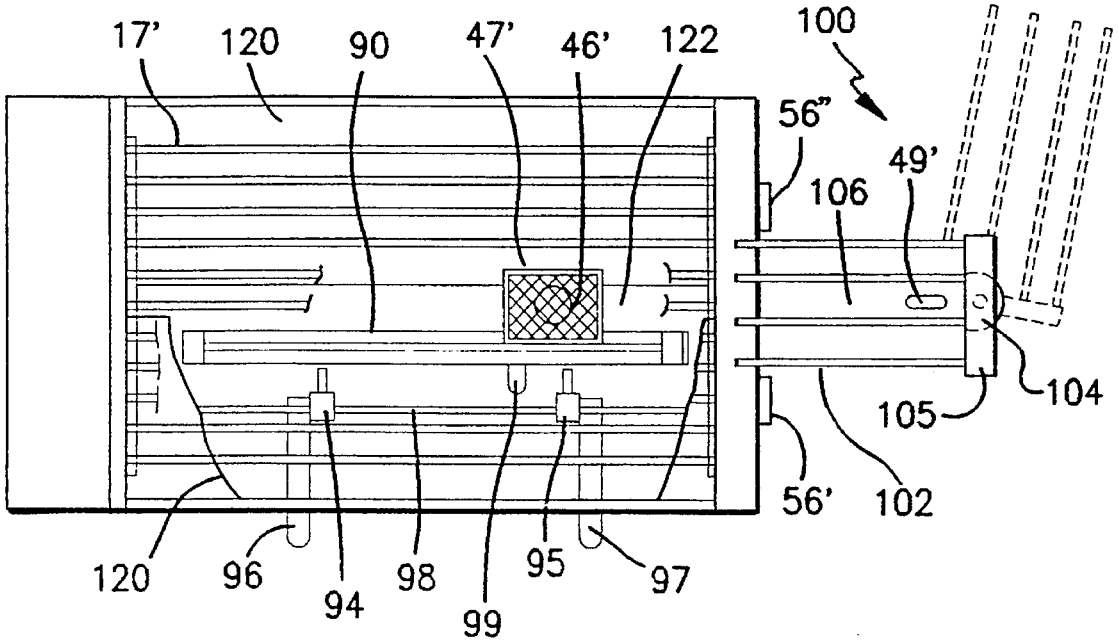
FIG. 8 is a plan view of the apparatus shown in FIG. 7.

The modified apparatus 10' shown in FIGS. 7 and 8 includes a loading device 100 which is of assistance in leading a joint of meat (particularly a heavy joint such as a large cut of beef) into a bag. The loading device comprises a rack consisting of four mutually parallel polished stainless steel rods 102 cantilevered from a bar 103. The bar comprises a horizontal centre portion 104 and outer portions 105 which project angularly upwardly from each end of the centre portion. The inner two rods join the bar at the ends of the centre portion and the outer rods join the bar at the ends of the outer portions. The outer rods are thus mounted at a higher level than the inner rods. A joint of meat which slides along the rods thus tends to be cradled centrally on the rack.

The loading device further comprises a mounting bracket which is mounted on the end of the frame 11' of the apparatus 10'. The bracket includes a horizontally disposed arm 106. A vertically disposed spigot 107 depends from the bar 103 and is pivotably mounted in the outer end of the arm 106. The rack is thus capable of swivelling about a vertical axis. In the position shown in the drawing the rack is disposed so that the rods project towards the open mouth of a bag B which has been formed on the apparatus 10'. This facilitates the loading of a joint of meat from the rack into the bag. The rack can however be swivelled to a loading position (shown in dotted outline at 108) in which the rods are aligned with a conveyer (not shown) which feed joints of meat to the machine. The loading of joints of moat from the conveyor now the rack is thus facilitated.

Referring again to FIGS. 7 and 8, a pair of plates 120 is provided at the top of the frame with a longitudinally disposed slot 122 therebetween. The belts 17' are mounted above the plates. A pneumatic ram 90 is mounted on the frame 11' below the plates 120 with its axis parallel to slot 122. The ram is preferably of the so called "rodless cylinder" type having a carriage 91 which runs along the body 92 of the ram. A suitable ram is model MYC25G700 supplied by SMC Corp of Tokyo, Japan. A vacuum head 47' is mounted on the carriage. The vacuum head projects through the slot 122. It may be noted that the bag opening head 49' is mounted on the arm 107.

Actuation of the ram 90 adjusts the position of the vacuum head. However, the provision of the ram enables the apparatus 10' to be operated in a way which is very convenient for the operator particularly where the apparatus will be handling joints of meat of a limited range of sizes. The positioning of the ram (and therefore of the vacuum head) can be determined by microswitches. In this example two such microswitches 94, 95 are used but more could be provided. They are fixed to handles 96,97 which are slidably mounted on a rail 98 under the ram. The position of the microswitch 94 determines the length of a short bag and the position of the microswitch 95 determines the length of a long bag. The microswitches are actuated by a trigger 99 mounted on the carriage 92. A kick switch 56' is operated for making a short bag and a separate kick switch 56" is provided for making a long bag. Operation of the kickswitch 56' disenables the microswitch 95 and operation of the kickswitch 56" disenables the microswitch 94.

At the start of a cycle the carriage (as will be, come clear) is fully advanced and the vacuum head is at the extreme end of its travel (to the right in FIG. 8). When, say, the kickswitch 56' is operated, the carriage retracts until the trigger 99 actuates the microswitch 94. This causes the drive rollers to feed the tube until its leading edge is sensed by the sensor 46'. The vacuum head and the heat scaling and cut-off mechanisms are activated to form a short bag B. Momentarily thereafter the bag opening head 49' is activated and the carriage 91 is advanced. The bag B is thus carried towards the loading device 100 while it is being opened. The bag and the air issuing from the head 49' are moving in opposite directions, assisting the opening of the bag. The rods 102 are positioned so that, when the head 47' reaches the limit of its travel to the right, the ends of the rods project into the open end of the bag. The bag is drawn by hand over the cut of meat on the rack. The rack is then swivelled so that the rack is located over a removal conveyer onto which the bagged cut of meat is discharged.

The cycle can be repeated from this point by again operating the kickswitch 56'. If, alternatively, the kickswitch 56" is operated, the machine will make a long bag. The bag lengths can be altered by repositioning the microswitches.

The vacuum head 47' incorporates a perforated grid (which can be seen in FIG. 8) to increase the effective area of the nozzle against which the lower layer of the tube is sucked. The proximity sensor 46' is incorporated in the vacuum head.

Either apparatus 10, 10' may be provided with various additional features to increase its utility.

For example it is likely that at least one device will be required to reduce or eliminate static electricity which occurs in the tube T. Such devices are known and do not need to be described in detail. One such device is shown schematically at 110.

Either apparatus 10, 10' can be designed so that it can be used (a) to make open-ended tubular packages; (b) to make unopened bags or packages; and (c) to produce bags or packages uninterruptedly. These respective functions can be achieved by incorporating in the control circuitry switches or the like which disenable the heat sealing ribbon 44; the bag opening bead 47, 47'; and which by-pass the kick-switches 56, 56', 56". There may be sufficient demand for an apparatus which produces unopened bags or open ended packages to justify (for price reasons) omission of the tube opening mechanism or the heat sealing mechanism.

A printing device may be mounted at a suitable location such as between the spindle assembly 12 and the drive roller assembly 14. Suitable printing devices are known per se, one such being sold under the name DATO/PACK™ marketed by Image Jet Printing Pte Ltd of Singapore. Another feature which may be provided is a counting device to count the number of bags produced by the apparatus and/or the length of tubular film used from each roll. Counting devices of this kind are also known per se.

The belts shown in the apparatus 10 are flat. The belts 17' shown in the apparatus 10' are of round cross section.

The apparatus is suitable for packaging meat in shrink-type packaging.

The apparatus can be used to form a package which is open at both ends. In this case the heat scaling mechanism can be inactivated or dispensed with.

Figure 9:
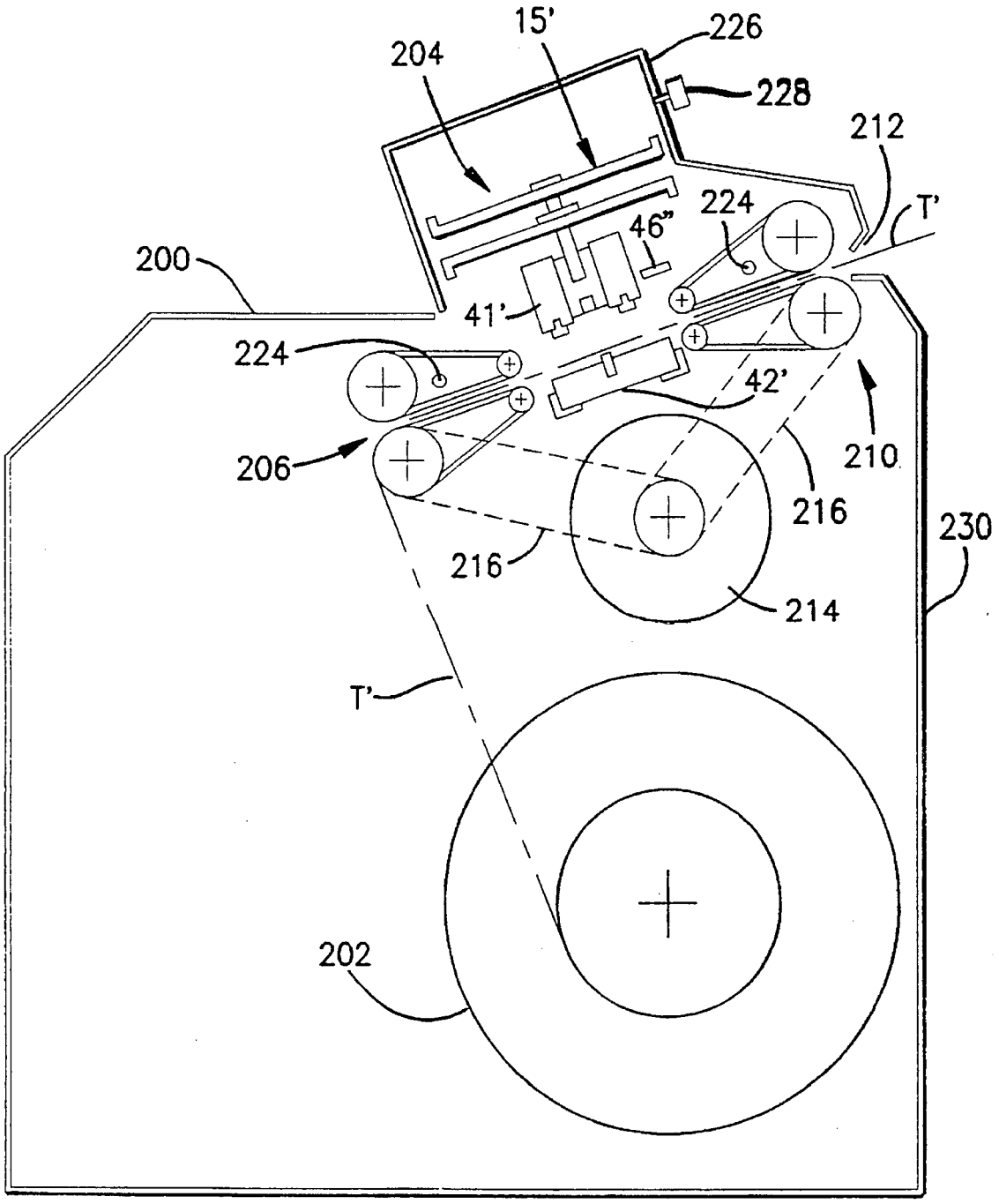
FIG. 9 is a partial side view of another modified apparatus.

In FIG. 9 there is shown a bag making machine comprising a cabinet 200 in which a spool 202 is rotatably mounted. An elongate flat tube (indicated by the chain dotted line T') of plastics film is rolled onto the spool before the spool is mounted on the machine. The mounting is such that the tube T' can be drawn off the spool and fed to a bag making apparatus 204 which is described in detail below. A braking device (not shown) may be provided which prevents the spool from turning unless tension is applied to the tube. The tube will not therefore be fed off the spool unless it is drawn off by the bag making apparatus. Mechanisms for mounting and braking the spool in this way are well known and need not be described here.

The bag making apparatus 204 comprises a first belt assembly 206, a heat scaling and cut-off device 15' and a second belt assembly 210. For convenience the heat sealing and cut-off device will be referred to simply as the "cut-off device". As indicated in the drawing, the tube T' is held in a flat plane as it passes through the apparatus 204. This plane however is inclined at an angle of about 20 degrees to the horizontal when the machine is in the attitude shown in the drawings. The tube is thus moving upwardly as it emerges from an opening 212 in the cabinet. The reason for this is explained below.

An electric motor 214 is mounted in the cabinet and, through an in-line helical gearbox (not shown) and sprocket chains (indicated by the dotted lines 216), drives both of the belt assemblies.

Each belt assembly 206, 210 is substantially similar to the assembly shown in FIG. 6 and need not be described in detail. Each assembly 206, 210 comprises a pair of large diameter rollers and a pair of small diameter rollers. Sets of endless resilient belts or bands are passed around the respective upper and lower pairs of rollers. The rollers are spaced so that the belts will grip a tube T' introduced therebetween and feed it through the cut-off device 15'.

It may be advantageous to connect a pneumatic ram to the upper large diameter roller in the belt assembly 210. This ram may conveniently be located above the said roller. Actuation of this ram would cause the said roller to apply variable pressure to the lower large diameter roller. A reduced pressure would enable a finished bag to be withdrawn by hand from the belt assembly 210 when the machine is operated in this mode. Increasing the pressure would prevent such withdrawal. This latter is a useful feature when the machine is operated in a mode in which it produces bags uninterruptedly.

It will be noted that, in both assemblies, it is the small diameter rollers which are located adjacent the cut-off device 15'. Because the assembly 210 is arranged to draw the tube T' through device 15' and feed it through the opening 212 in the cabinet, the small diameter rollers in the assembly 210 are located further apart than the large diameter rollers. This is to facilitate entry of the leading edge of the tube between the bands of the assembly 210.

Incidentally, to prevent the tube from bunching up in the device 15' or between the two belt assemblies, the assembly 210 is driven a little (i.e. about 10%) faster than the assembly 206 so that part of the tube between the two belt assemblies is held in tension. However the grip of the second belt assembly 210 on the tube is less than that of the first belt assembly. The reason for this is that after a bag is made, it must be possible to withdraw it from the belt assembly 210 by hand while the assembly 210 remains stationary. Thus while some slippage must be allowed for in the second belt assembly 210, any such slippage is undesirable in the first belt assembly 206.

Figure 4:
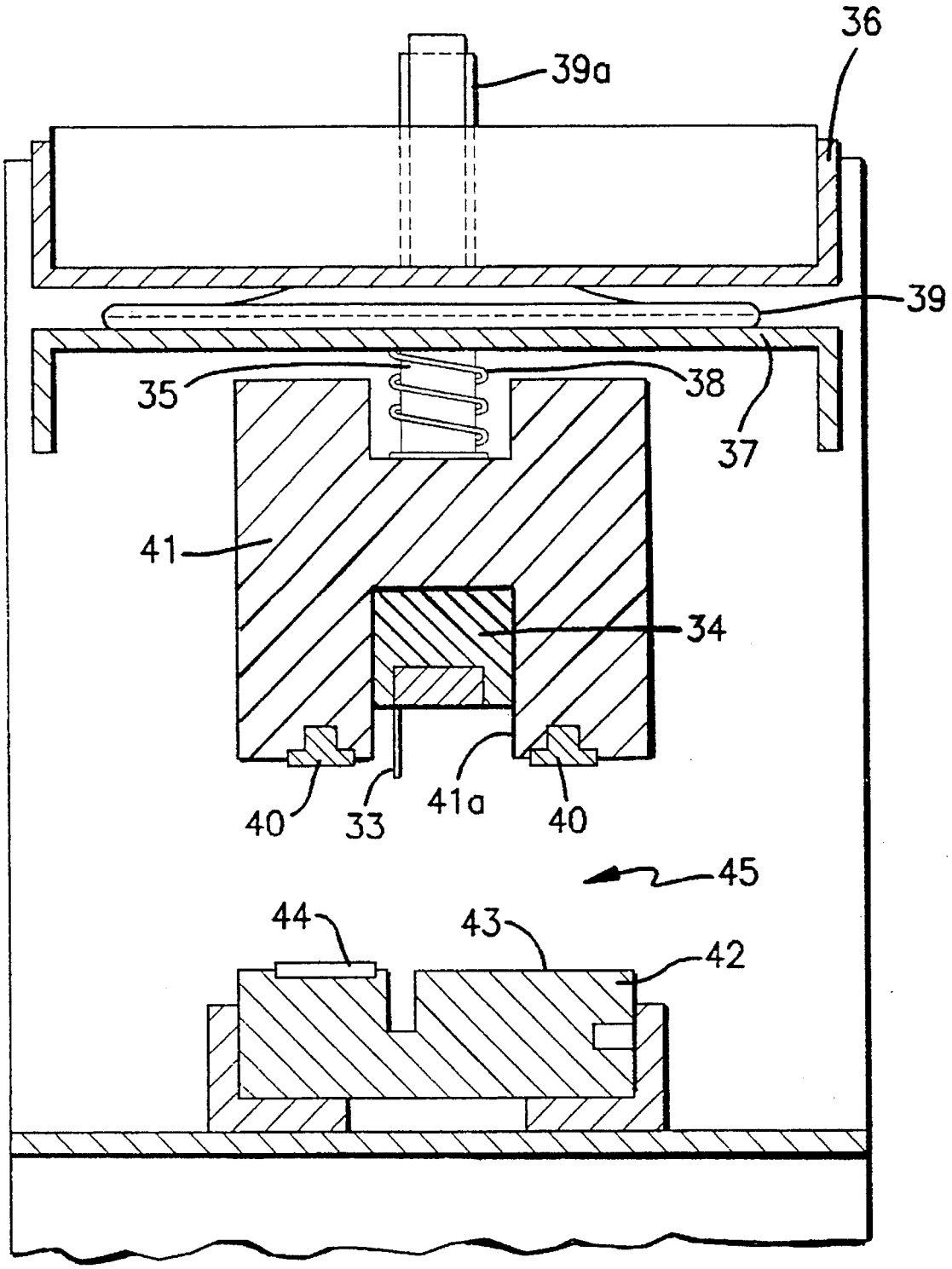
FIG. 4 is a detailed sectional view of a heat sealing and cut off mechanism.

The device 15' is substantially identical to the device shown in FIG. 4 and will not be described in detail here. However, its function will be briefly described. When a predetermined length of the tube T' has been advanced through the device 15', the belt assemblies (and thus the tube) are stopped and a head 41' is brought down against the plate 42'. At this time a blade mounted on the head cuts off the portion of the tube which has been advanced through the device 15' and a heating bar heat seals the said portion along the edge which has just been cut. The said portion is thus formed into a bag the front end of which projects through the opening 212 of the cabinet.

It is desirable to provide one or more anti-static bars to prevent the tube T' sticking to the parts of the machine with which it comes into contact. Two such anti-static bars are shown at 224.

Figure 10:
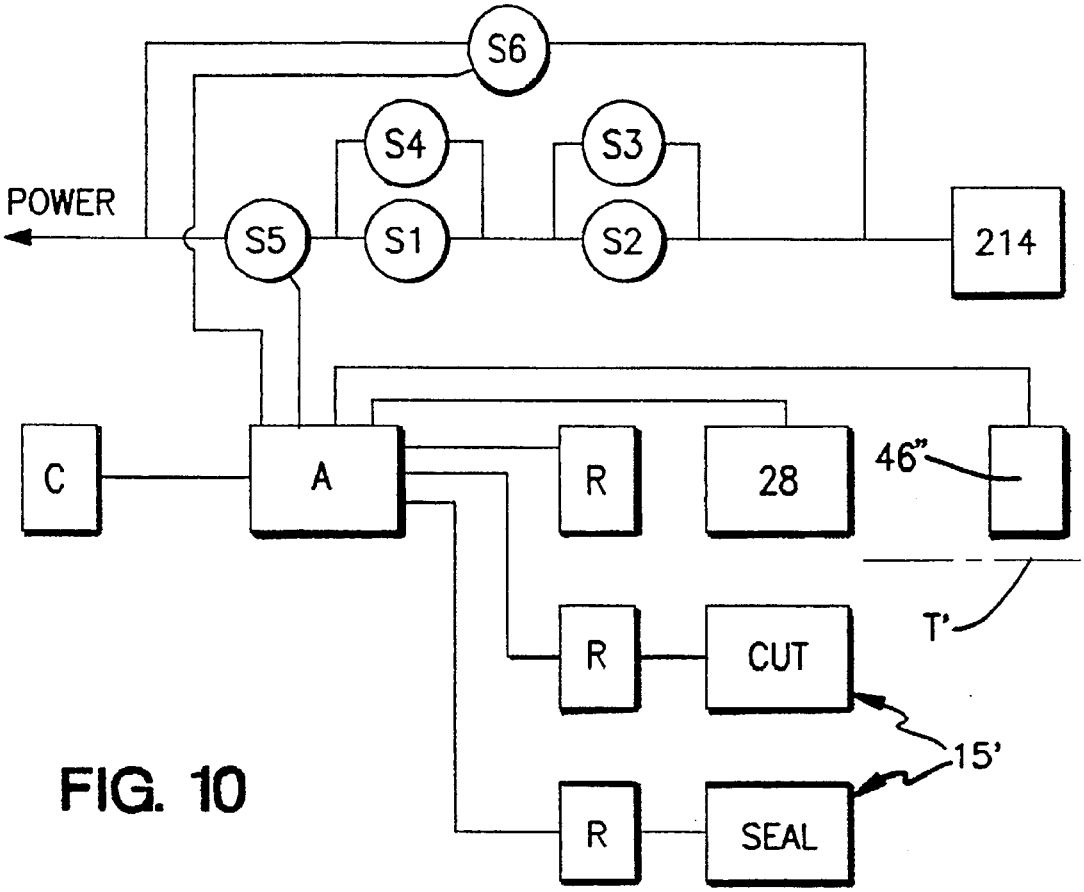
FIG. 10 is a block diagram showing a schematic arrangement of some of the electronic controls of the apparatus shown in FIG. 9.

Referring now in particular to FIG. 10, in the following discussion, unless otherwise stated, the electronic components and circuitry which are described for controlling the machine are either commercially available or could be designed by those skilled in the art without substantial difficulty. It is therefore not considered necessary to describe such components or circuitry in detail.

In the first place a sensor 46" is located just above the exit to the device 15'. This sensor 46" detects the presence of the tube T'. When the bag is removed from the roller assembly 210 and is thus no longer detected by the sensor 46", the sensor closes a switch S1 and thereby readies the machine to produce the next bag. In one mode of operation of the machine the next bag will be produced when a switch S2 is actuated. In another mode of operation of the machine the switch S2 is by passed by switch S3. Thus the next bag is produced by the act of removal of the first bag from the assembly 210. The circuit also includes a switch S4 which by passes the switch S1 and thus (if the switch S3 is closed)

causes the machine to produce bags uninterruptedly until it is stopped; and a switch S5 which, through a timing device A actuated by the sensor immobilises the machine if no tube is detected within a preset short period after a bag has been removed from the belt assembly 210. This is to prevent the tube being fed off the spool if it is not advancing through the device 15 '.

The sensor 46" can be light activated but this is not essential.

In the present example, the length of the bag which is produced is determined by counting the number of revolutions of the electric motor which drives the belt assemblies and to stop the motor after a number of revolutions (which can be varied as required) have been counted. For this purpose an electronic counting circuit including a timer T is mounted in the cabinet. The counting circuit includes relays R which control the supply of power to the motor, the cutting device and the heat sealing device. In the present case the counting circuit includes a control device C mounted on the face plate 226 of the cabinet and having a knob 228 which is turned to alter the setting of the circuit. A suitable PLC device is commercially available from the Mitsubishi company of Japan, catalogue number Melsec FI-20-MR-BS. The knob has a pointer which registers with a scale graduated to read out the bag length conforming to the setting of the knob.

Of course, the machine shown in FIG. 9 may also be provided with one or more default switches (one being indicated at S6 in FIG. 10), actuation of which automatically causes the machine to produce a package of preprogrammed length, irrespective of the setting of the control knob 228.

Other controls and indicators are located on the face plate 226. The indicators include:

(a) a light which shows that a bag has been formed and is ready for removal;

(b) a light showing that the machine is switched on; and (c) a light that shows that the machine is not in a safe condition to operate. Typically, this might arise if one or other of the covers or doors of the machine are not closed. It is desirable that door- and cover-operated switches immobilise the machine when they are not closed.

The controls may alternatively or in addition include a switch to switch the machine between two modes of operation in the first of which a bag is made in response to detection by a sensor of a mark on the tube. Since the marks on the robe will normally be evenly spaced apart, bags of uniform length will be made in this mode. In the second mode the sensor is inoperative so that the bag length will be determined by the other means mentioned above.

In a variant of the above the marks could be spaced closely and the sensor could be integrated with an electronic counter. A bag would thus be made only after a programmed number of marks has passed the sensor.

In another variant, instead of counting the revolutions of the motor 214, the timer could be arranged to supply power to the motor for a time interval which can be readily varied by the operator. Alternatively the controls, in addition to the timer, could include a rheostat or some other device to enable the operator to readily vary the power supplied to the motor (and hence the speed thereof) for a fixed time interval. Either of these arrangements would result the production of bags of readily variable length. Both the timer and the power control device could be set by means of control knobs calibrated against scales corresponding to the required length of a bag.

In yet another variant the control knob and related circuitry could in each case could be replaced by a keyboard and numerical display may be mounted on the face plate and integrated with suitable circuitry. The length of the bag required would then be entered on the keyboard. A suitable keyboard device with digital display is commercially available from the Mitsubishi company, catalogue number F-20-$DU_2$-E-SET.

It will be clear to the skilled addressee that the usefulness of all of the machines described herein and illustrated in the drawings is dependent on the ability of the machines to produce bags so quickly as not materially to slow down the output of the operator. The rate of bag production can vary according to what the machine is designed to be used for. In conventional meat packaging operations, for example, a human operator of average capabilities, is capable of packaging, in sustained way, up to about 15 cuts per minute. All of the machines illustrated in the drawings are able to produce a bag in about 4 seconds. It might be supposed that the time taken to adjust the machine for producing a different bag length would reduce the rate of production of bags but this need not be so. The reason for this is that in the case of machines such as the examples illustrated in FIGS. 1 to 8 in which the length adjustment is manual, such adjustment can easily be made while the leading portion of tube to make a bag is being fed out of the rollers. On the other hand, in the case of a machine in which the length adjustment is carried out by punching a key pad, the adjustment for setting the length of the following bag can be selected while a first bag is still being produced. Bag length adjustment when a preset switch is used is substantially instantaneous. Therefore in practice the adjustment step need have no substantial effect on the rate of production of bags.

Figure 5:
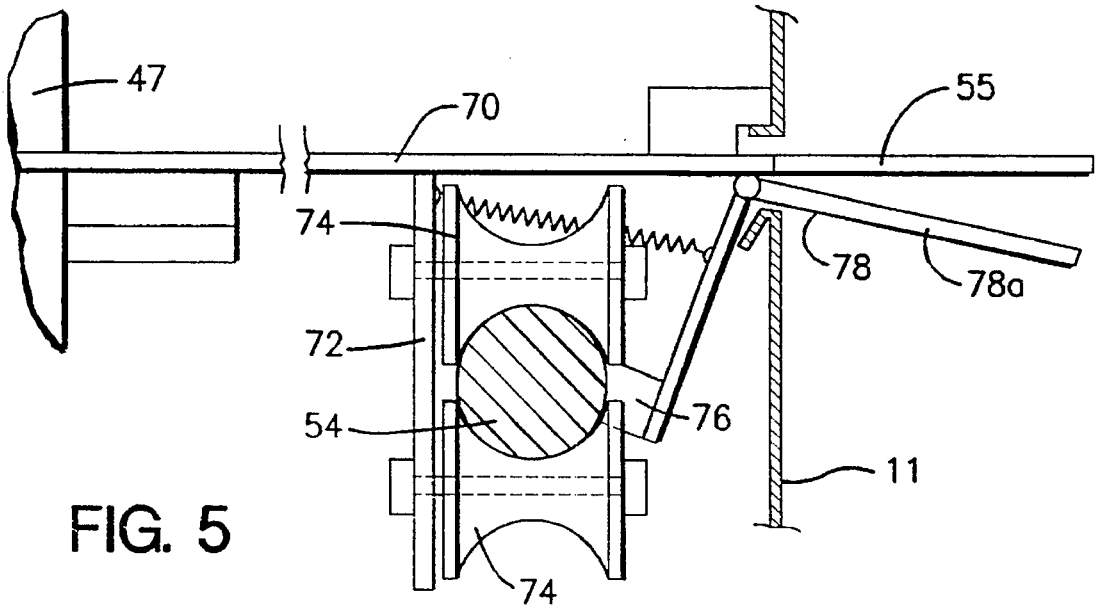
FIG. 5 is a detailed view of the manner of positioning a tube opening mechanism of the apparatus.

Of the machines described herein and illustrated in the drawings, the length adjustment step is slowest in the apparatus shown in FIG. 5, which comprises the plate 70 which is moved manually along the track 54 after first releasing the brake device 76. An operator is able to make this adjustment in less than a second. This is a negligible mount of time compared to the time (which is certainly of the order of five minutes at the least) taken to adjust the bag length of the conventional machines discussed in the introduction to this specification.

One of the advantages of the machine shown in FIG. 9 is that it is compact and can be mounted overhead so that it takes up less floor space in a packaging plant. In this case the machine is mounted with the face 230 of the cabinet horizontally disposed and facing downwards. The bags are thus fed downwardly out of the opening 212. It is in this application that the aforementioned inclination of the bag making mechanism 204 is important. If the mechanism was not inclined the leading edge of the tube T' between the belt assembly 206 and the cutter of the mechanism 15' would tend to hang freely with an increased likelihood of being out of alignment as it approached the belt assembly 210. When the apparatus 204 is inclined the tube remains in contact with the plate 42' and is accurately guided towards the belt assembly 210.

Figure 11:
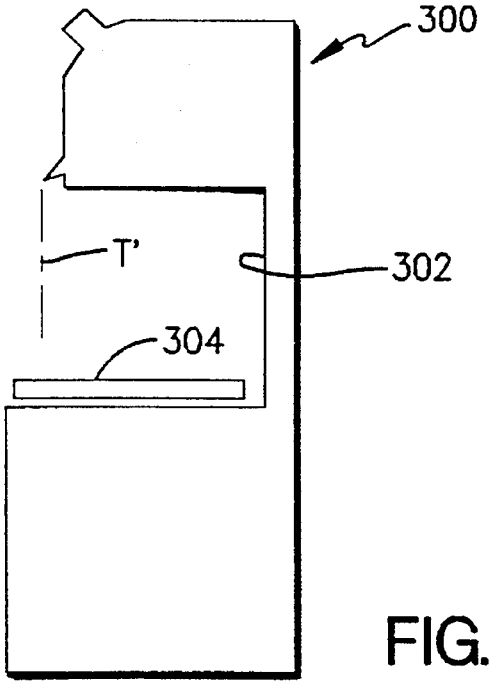
FIG. 11 is a side view of the profile of a modified packaging apparatus.

The cabinet of the machine shown in FIG. 9 can be modified as illustrated in FIG. 11, wherein the cabinet 300 has a cut out portion 302. This accommodates a conveyer indicated schematically at 304 which is positioned at the operators' waist height. The bag making apparatus 204 is mounted in the part of the cabinet above the cut out portion and the spool 202 is mounted in the cabinet below the cut out portion. The cabinet 300 takes up very little floor space and is very useful for locating in existing packaging plants where space is limited. The cabinet may be mounted on rollers or castors which is more convenient than mounting an entire apparatus overhead as suggested in the previous paragraph.

The provision of electronic controls also enables the machine to be used in conjunction with a conveying apparatus which brings articles of varying length to the bag making machine for packaging. The conveying apparatus can be provided with means of known kind which electronically determines the length of each article. Such means can be integrated with the controls of the bag making machine to cause it automatically to produce a bag of the correct length suitable for each article as it arrives at the bag making machine.

The bag length can also be determined by a human operator who located at a work station remote from the station where the machine is located.

When the machine is placed overhead it is convenient to provide a control box on the end of a cable which hangs don from the machine.

The nature of the plastics film may vary. The machine described is, for example, suitable for heat sealable material and vacuum packing material.

It is not intended that the scope of a patent granted in pursuance of the application of which this specification forms a part should exclude modifications and/or improvements to the embodiments described and/or illustrated which are within the scope of the invention as defined in the claims or be limited by details of such embodiments further than is necessary to distinguish the invention from the prior art.

We claim:

1. Apparatus for producing discrete bags on demand from a stock of flexible laminar packaging material in the form of a flat elongate tube, said bags being intended for packaging articles which may be of different length, the apparatus being operable in a mode of operation in which the apparatus retains each produced bag at a predetermined location from which the bag is removed by an operator and in which the operation of the apparatus is interrupted after each bag is produced so that the timing of production of each bag can be controlled by the operator, the apparatus comprising:

bag forming means including tube feed means comprising a motor coupled to at least one drive roller for feeding successive leading portions from said tube, and sealing means for sealing each said leading portion adjacent an edge of such leading portion along which edge said tube is cut to separate such leading portion from said tube;

electronic control means for immobilizing the bag forming means after each said leading portion is fed to the predetermined location, a switch means for restarting the bag forming means, and length determining means interconnected with the motor to cause the motor and drive roller to determine the length of each said leading portion fed from said tube, the length determining means being adjustable so that the length of each bag formed can be selected to suit the length of an article to be packaged therein; and means for suspending each produced bag in the predetermined location where said bag is retained without being opened until said bag is removed by the operator.

2. Apparatus according to claim 1, wherein the control means further comprises a detecting means which, upon detecting the removal of a bag from the predetermined location, provides a signal which automatically actuates the switch means to restart the bag forming means.

3. Apparatus according to claim 2, wherein the detecting means comprises a light actuated proximity sensor.

4. Apparatus according to claim 2, further comprising means for disabling the signal which automatically actuates the switch means so that the switch means must be manually actuated to restart the bag forming means.

5. Apparatus according to claim 1, wherein the length determining means includes at least one preselector means which upon actuation causes the motor and drive roller to feed a leading portion of preset length from the tube.

6. Apparatus according to claim 1, wherein the length determining means includes a device comprising a keypad in which the operator can enter information for determining the length of a leading portion fed by the motor and drive roller after the bag forming means is restarted.

7. Apparatus according to claim 1, wherein the length determining means comprises an electronic processor capable of receiving information stored by the processor and which information is used by the processor to determine the length of a leading portion fed by the motor and drive roller after the bag forming means is restarted.

8. Apparatus according to claim 1, wherein the produced bag is held suspended in the predetermined position by gripping means arranged to grip such bag adjacent said edge.

* * * * *